United States Patent [19]

Akaike et al.

[11] Patent Number: 5,035,584

[45] Date of Patent: Jul. 30, 1991

[54] VARIABLE-DELIVERY VANE-TYPE ROTARY COMPRESSOR

[75] Inventors: Seiji Akaike; Toshinori Aihara; Yukio Sudo, all of Atsugi, Japan

[73] Assignee: Atsugi Motor Parts Co., Ltd., Kanagawa, Japan

[21] Appl. No.: 114,652

[22] Filed: Oct. 28, 1987

[30] Foreign Application Priority Data

| | | | |
|---|---|---|---|
| Oct. 31, 1986 | [JP] | Japan | 61-168556 |
| Nov. 4, 1986 | [JP] | Japan | 61-170038 |
| Dec. 3, 1986 | [JP] | Japan | 61-187105 |

[51] Int. Cl.[5] ..... F04B 49/00; F04B 49/02

[52] U.S. Cl. ..... 417/295; 417/310

[58] Field of Search ..... 417/295, 310

[56] References Cited

U.S. PATENT DOCUMENTS

| | | | |
|---|---|---|---|
| 3,515,496 | 6/1970 | Eddy | 417/440 |
| 4,137,018 | 1/1979 | Brucken | 417/440 |
| 4,726,740 | 2/1988 | Sozuki et al. | 417/310 |
| 4,778,352 | 10/1988 | Nakajima | 417/310 |
| 4,881,878 | 11/1959 | Kobayashi et al. | 417/295 |
| 4,887,943 | 12/1989 | Kobayashi et al. | 417/295 |

*Primary Examiner*—Leonard E. Smith

*Attorney, Agent, or Firm*—Bachman & LaPointe

[57] ABSTRACT

A variable-delivery vane-type rotary compressor including receiving means for defining a space for rotatably receiving a disc-shaped rotary closure member, which is associated with one of the end openings of a by-pass passage, within the end wall of a compression chamber. The receiving means may also be provided on the peripheral wall of the compression chamber. The bearing means is provided between the rotary closure member and the end wall of the compression chamber.

14 Claims, 10 Drawing Sheets

VARIABLE-DELIVERY VANE-TYPE ROTARY COMPRESSOR

BACKGROUND OF THE INVENTION

1. Field of the Invention

The present invention relates to a rotary compressor, particularly to a variable-delivery vane-type rotary compressor which is used as a refrigerant compressor for an air conditioner for a vehicle or the like.

2. Description of the Background Art

Generally, in order to control discharge in vane-type rotary compressor, a suction port being in communication with the interior of a cam ring is provided on a side block which covers one end of the cam ring and the position of the suction port is changed, so that the starting position of compression caused by rotation of the vanes is changed.

For example, a variable-delivery vane-type rotary compressor, which is a background art of the present invention, includes an arc-shaped by-pass port, which is provided in a front plate so as to extend beside the cam surface of a cam ring, the end opening of which may open on any radial section of a working chamber, and a rotatable disc having an arc-shaped opening between the front plate and the cam ring. In this compressor, the rotatable disc may rotate by means of an electric motor provided within or outside the compressor so as to change the position of by-pass opening in order to control discharge.

However, since the rotatable disc having a by-pass opening is provided in addition to the front plate in this compressor in order to control the area of the by-pass port, there are disadvantages in that the compressor has a complicated construction, is relatively heavy and is expensive to manufacture.

The Japanese Patent First Publication (Jikkai) Showa 59-76786 discloses a variable-delivery vane-type rotary compressor which includes a suction opening provided in a front plate, the end opening of which is in communication with a working chamber, and a rotatable disc provided between the front plate and a rotor. The rotatable disc is provided with a suction port which is in communication with the suction opening. By rotating the rotatable disc about the axis of the rotor, the opened area of the suction port is changed, so that discharge of the compressor can be controlled.

However, since the rotatable disc is provided between the front plate and the rotor in this compressor, the rotatable disc is biased toward the front plate due to thrust load P of the rotor, i.e. $P=D^2\times\pi/4\times\Delta P$ in which D is the diameter of the shaft of the rotor and $\Delta P$ is the difference between opposing pressures applied to the opposite ends of the shaft. Therefore, it is difficult for the rotatable disc to rotate smoothly since friction force between the rotatable disc and the front plate is increased. As a result, since the driving force required for driving the rotatable disc is increased, there is a disadvantage in that the parts which actuate the rotatable disc become large, so that the overall weight of the compressor is increased.

SUMMARY OF THE INVENTION

It is therefore a principal object of the present invention to eliminate the aforementioned disadvantages and to provide a variable-delivery vane-type rotary compressor which has simple structure and light weight and which has a decreased manufacturing cost. Another object of the invention is to provide a variable-delivery vane-type rotary compressor which can allow its rotatable member to rotate smoothly so that discharge of the compressor can be varied smoothly.

In order to accomplish the aforementioned and other specific objects, a variable-delivery vane-type rotary compressor, according to the present invention, includes receiving means for defining a space for rotatably receiving a rotary closure member, which is associated with one of the end openings of a by-pass passage, within the end wall of a compression chamber.

According to one aspect of the present invention, the rotary compressor comprises:

a compressor housing defining therein an internal space which includes a low-pressure chamber connected to a low-pressure fluid source and a high-pressure chamber connected to a load;

introducing means for introducing a low-pressure fluid into the low-pressure chamber;

compression means for compressing the low-pressure fluid to a predetermined higher pressure, the compression means including a compression chamber for introducing the low-pressure fluid thereinto for compression;

passage means for defining a by-pass passage establishing communication between the low-pressure chamber and the compression chamber, the by-pass passage having end opening exposed to the low-pressure chamber and the compression chamber;

rotary closure member associated with one of the end openings of the by-pass passage for varying position of the end opening so as to control the amount of the low-pressure fluid by-passed form the compression chamber to the low-pressure chamber through the by-pass passage; and receiving means for defining a space for rotatably receiving the rotary closure member within the peripheral wall of the compression chamber.

The compression means may comprises a cam ring, the interior of which is provided with a cam surface, a rotor rotatably housed in the cam ring, at least one working chamber formed by the compressor housing, the cam ring and the rotor, and a plurality of vanes inserted into the rotor, the vanes being movable inwardly and outwardly, and the tips of which slide in contact with the cam surface. In addition, the rotary closure member may be a disc-shaped member which is provided with at least one by-pass opening at the circumference thereof, through which a part of the low-pressure fluid is by-passed form the compression chamber to the low-pressure chamber. The space for rotatably receiving the rotary closure member is preferably a circular opening provided in the compression chamber so that the disc-shaped member is rotatably supported by the inner peripheral wall of the circular opening. Preferably, the by-pass opening is an arc-shaped opening. The compressor may further comprise an actuating means for actuating the disc-shaped member and for controlling the amount of the low-pressure fluid to be by-passed from the compression chamber to the low-pressure chamber through the passage means. The actuating means may be an actuator cylinder which comprises a cylinder and a piston slidably inserted into the cylinder, so that the longitudinal displacement of the cylinder is transmitted to the disc-shaped member by means of an actuating pin provided on the disc-shaped member so as to allow the disc-shaped member to rotate. The fluid may be a refrigerant gas. In this case, the low-pressure chamber may be connected to an evaporator and the high-pressure chamber may be connected to a condenser.

According to other aspect of the invention, the rotary compressor comprises:

a compressor housing defining therein an internal space which includes a low-pressure chamber connected to a low-pressure fluid source and a high-pressure chamber connected to a predetermined load;

introducing means for introducing a low-pressure fluid into the low-pressure chamber;

compression means for compressing the low-pressure fluid to a predetermined higher pressure, the compression means including a compression chamber for introducing the low-pressure fluid thereinto for compression;

passage means for defining a by-pass passage establishing communication between the low-pressure chamber and the compression chamber, the by-pass passage having end openings exposed to the low-pressure chamber and the compression chamber;

rotary closure member associated with one of the end openings of the by-pass passage for varying position of the end opening so as to control the amount of the low-pressure fluid by-passed from the compression chamber to the low-pressure chamber through the by-pass passage; and receiving means for defining a space for rotatably receiving the rotary closure member, the receiving means being provided on the peripheral wall of the compression chamber.

The compression means may comprise a cam ring, the interior of which is provided with a cam surface, a rotor rotatably housed in the cam ring, at least one working chamber formed by the compressor housing, the cam ring and the rotor, and a plurality of vanes inserted into the rotor, the vanes being movable inwardly and outwardly, and the tips of which slide in contact with the cam surface. The rotary closure member is preferably a ring-shaped member which is provided with at least one by-pass opening at the circumference thereof, through which a part of said low-pressure fluid is by-passed from the compression chamber to the low-pressure chamber. The receiving means may comprise outer and inner rings so that the ring-shaped member is rotatably supported between the outer and inner rings. The thickness of the ring-shaped member is preferably less than that of outer and inner rings so that the ring-shaped member can rotate smoothly.

According to other aspect of the invention, the rotary compressor comprises:

a compressor housing defining therein an internal space which includes a low-pressure chamber connected to a low-pressure fluid source and a high-pressure chamber connected to a predetermined load;

introducing means for introducing a low-pressure fluid into the low-pressure chamber;

compression means for compressing the low-pressure fluid to a predetermined higher pressure, the compression means including a compression chamber for introducing the low-pressure fluid thereinto for compression;

passage means for defining a by-pass passage establishing communication between the low-pressure chamber and the compression chamber, the by-pass passage having end openings exposed to the low-pressure chamber and the compression chamber;

rotary closure member associated with one of the end openings of the by-pass passage for verying position of the end opening so as to control the amount of the low-pressure fluid by-passed from the compression chamber to the low-pressure chamber through the by-pass passage;

receiving means for defining a space for rotatably receiving the rotary closure member, the receiving means being provided on an end wall of the compression chamber; and bearing means for allowing the rotary closure member to rotate smoothly.

The bearing means may be a thrust bearing and/or a pad(s). The rotary closure member is preferably a disc-shaped member which is provided with at least one by-pass opening at the circumference thereof, through which a part of the low-pressure fluid is by-passed from the compression chamber to the low-pressure chamber. In this case, the receiving means may have a circular opening by which the disc-shaped member is rotatably supported. The bearing means may be provided either on the surface of the disc-shaped member facing an end wall of the compression chamber or on the surface of an end wall of the compression chamber facing the disc-shaped member. The bearing means is preferably a low-friction, ring shaped thrust bearing or pad(s). The bearing means may be also a thin ring-shaped pad comprising a low-friction member, the thin ring-shaped pad being disposed between the opposing surfaces of the ring-shaped disc and the end wall of the compression chamber. Either the disc-shaped member or the end wall of the compression chamber may comprise a low-friction material.

BRIEF DESCRIPTION OF THE DRAWINGS

The present invention will be understood more fully from the detailed description given herebelow and from the accompanying drawings of the preferred embodiment of the invention. The drawings are not intended to imply limitation of the invention to this specific embodiment, but are for explanation and understanding only.

In the drawings.

DESCRIPTION OF THE PREFERRED EMBODIMENT

Figure 1:
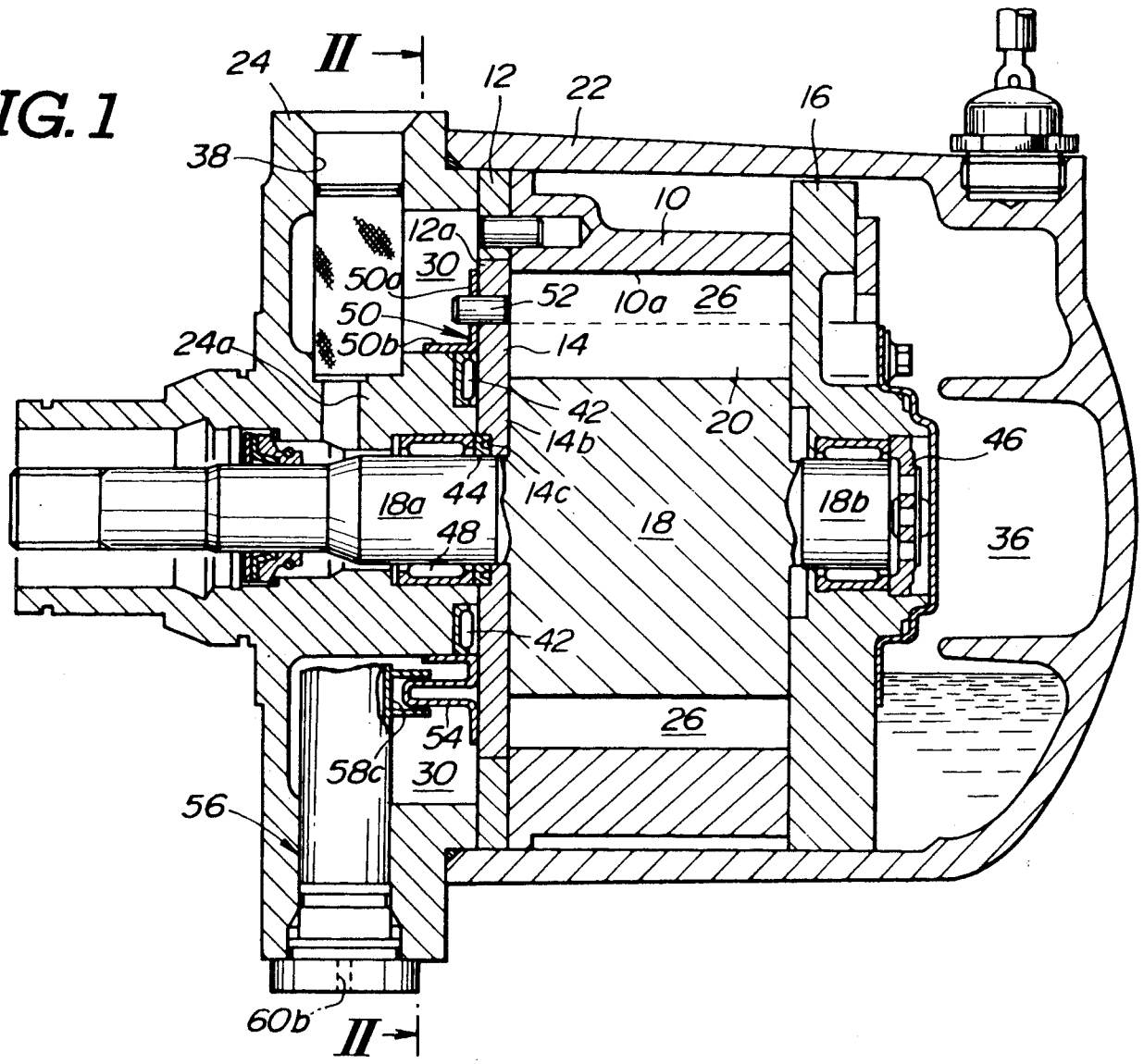
FIG. 1 is a sectional view of the first preferred embodiment of a variable-delivery vane-type rotary compressor according to the present invention.

Referring now to the drawings, particularly to FIGS. 1 to 4, the first preferred embodiment of a variable-delivery vane-type rotary compressor, according to the present invention, is described below.

A variable-delivery vane-type rotary compressor includes a cylindrical cam ring 10. A cam surface 10*a*, which has an essentially elliptical cross-section, is formed on the inside surface of the cam ring 10. The cam ring 10 is equipped with a front plate 12, in which a circular opening 12*a* is formed, at the front open end. A rotatable disc 14 is inserted into the circular opening 12*a*. In addition, the cam ring 10 is equipped with a rear plate 16 at the rear open end so as to cover the open ends of the cam ring 10 together with the front plate 12 and the rotatable disc 14. A cylindrical rotor 18 is rotatably housed in the cam ring 10 between the front plate 12, the rotatable disc 14 and the rear plate 16. A plurality of vanes 20 are inserted into the rotor 18. The vanes 20 can move inwardly and outwardly so that the tips of the vanes 20 are in slidable contact with the cam surface 10*a*. The cam ring 10, the front plate 12, the rotatable disc 14, the rear plate 16, the rotor 18 and the vanes 20 are housed in a cylindrical housing 22 having a bottom. The front open end of the housing 22 is covered with a head cover 24 which is fixed to the housing 22 by means of a bolt not shown.

Figure 2:
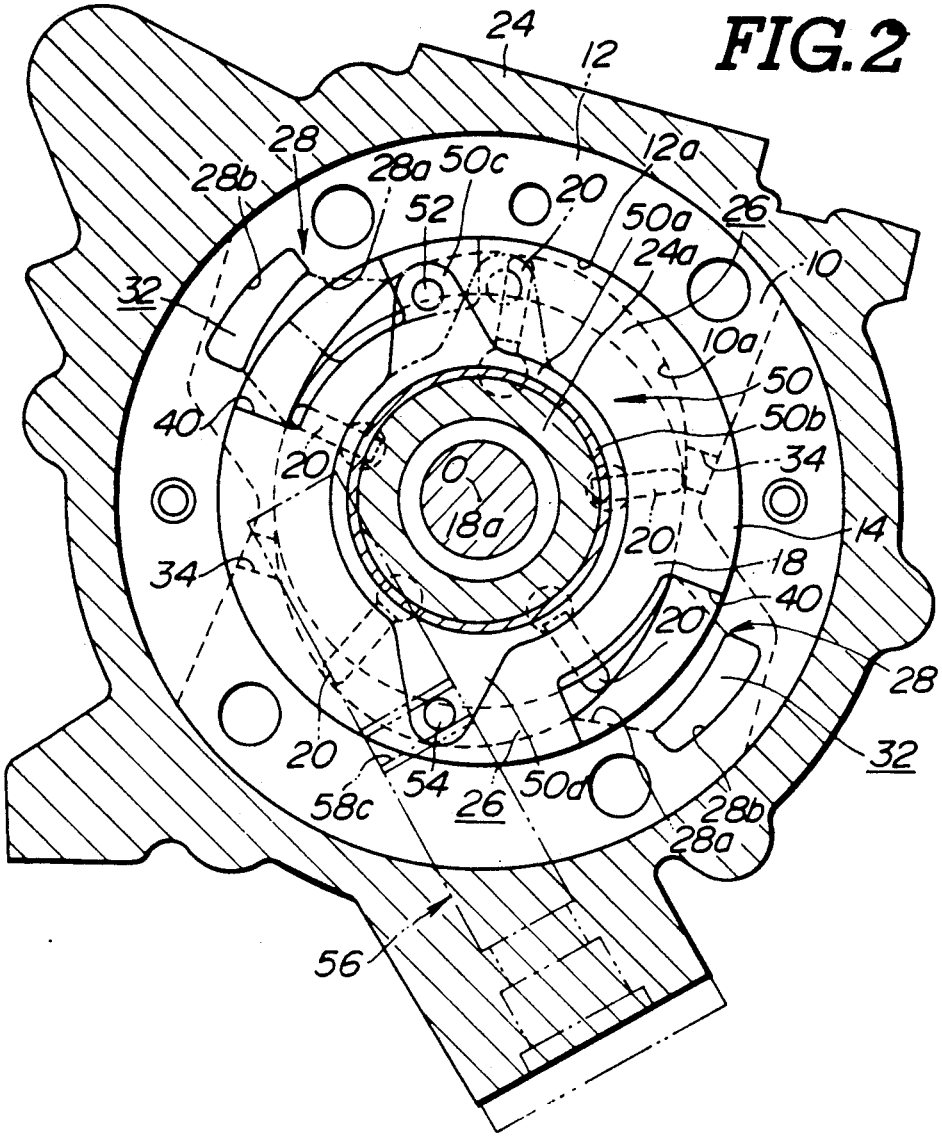
FIG. 2 is a sectional view of the compressor taken along the line X—X in FIG. 1.

A pair of working chambers 26 are formed between the cam ring 10 and the rotor 18. As shown in FIG. 2, the working chambers 26 respectively are in communication with a pair of suction ports 28, the end openings of which are formed in the cam surface 10*a*. The communication between the suction port 28 and the working chamber 26 is blocked when the volume of the part of the working chambers 26, which is divided by the vanes 20, is maximal. Each of the suction ports 28 comprises a plurality of openings 28*a*, the end openings of which are formed on the cam surface 10*a* of the cam ring 10, and an opening 28*b* which extends from the outer surface of the cam rings 10 so as to be in communication with an aspirator chamber 30 by means of a suction opening 32 formed in the front plate 2. In addition, a pair of discharge ports 34 is formed on the cam ring 10 at a location corresponding to the clockwise end of the working chamber 24. The communication between a discharge chamber 36, which is formed in the housing 22, and the working chamber 26 is established by means of a discharge valve provided in the discharge port 34.

The aspirator chamber 30 is formed by the front plate 12, the rotatable disc 14 and the head cover 24. The head cover 24 is provided with an inlet 38 through which a refrigerant gas is introduced into the aspirator chamber 30. The refrigerant gas is supplied to each of the working chambers 26 through the suction openings 32 and the suction port 28.

Figure 3:
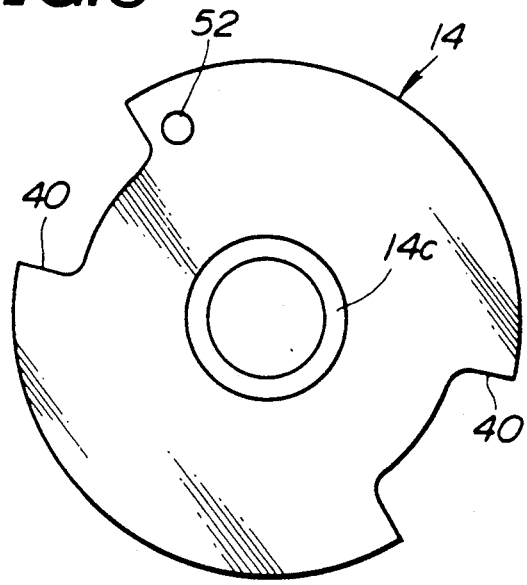
FIG. 3 is a plan view of a rotatable disc used in the compressor in FIG. 1.

As shown in FIG. 2, the circular opening 12*a* of the front plate 12 is formed so that the center thereof corresponds to the rotating axis O of the rotor 18. The opening 12*a* opens onto the working chamber 26 and is communication with the aspirator chamber 30. In addition, the rotatable disc 14 inserted into the opening 12*a* of the front plate 12 is supported by the front plate 12 so as to be rotatable about the rotating axis of the rotor 18. As shown in FIG. 3, a pair of arc-shaped by-pass openings 40 are formed on the rotatable disc at the circumference thereof. The by-pass openings 40 are opened on the actuator chambers 26 beside the cam surface 10*a* to establish the communication between the working chamber 26 and the aspirator chamber 30. The position of the by-pass opening 40 relative to the working chamber 26 is moved by rotating the rotatable disc 14, so that the amount of the refrigerant gas by-passed from the working chamber 26 to the aspirator chamber 30 is changed, thereby the discharge of the compressor can be controlled.

As shown in FIG. 1, a thrust bearing 42 is provided between the head cover 24 and the rotatable disc 14 in order to allow the rotatable disc 14 to rotate smoothly. Thrust load of the rotor 18, which thrusts the rotatable disc 14 against the head cover 24, is applied to the thrust bearing 42 so that the rotatable disc 14 can rotate smoothly.

In addition, the inner periphery 14*b* of the rotatable disc 14 is provided with a circular groove 14*c* into which a seal member 44 is inserted. The inner periphery of the seal member 44 is in slidable contact with a front-side shaft 18*a* of the rotor 18. The pressure of lubricating oil in the discharge chamber 36 at its bottom is decreased to the medium pressure between the discharge pressure and the suction pressure by means of a throttle valve 46 provided on the rear side of a rear-side shaft 18*b* of the rotor 18. The medium-pressure lubricating oil is introduced into the groove of the rotor 18, in which the vanes 20 are inserted. The seal member 44 prevents the medium-pressure lubricating oil from running into the low-pressure portion, i.e. the aspirator chamber 30 or a bearing 48 which supports the shaft 5*a* of the rotor 5.

A ring plate 50 is provided between the rotatable disc 14 and the head cover 24. The ring plate 50 comprises a plate portion 50*a* and a boss portion 50*b*. The plate portion 50*a* is in slidable contact with the front surface of the rotatable disc 14 and the inner periphery of the boss portion 50*b* is in slidable contact with the outer periphery of the boss portion 24*a* of the head cover 24 so that the ring plate 50 can rotate. As shown in FIG. 2, the plate portion 50*a* of the ring plate 50 is provided with a pair of projecting portions 50*c* and 50*d* which project radially from the outer periphery of the plate portion 50*a*. The project portion 50*c* is connected to the rotatable disc 14 by means of an actuating pin 52. On the other hand, a circular actuating projection 54, which projects toward the front side, is formed on the project portion 50*d*.

Figure 4:
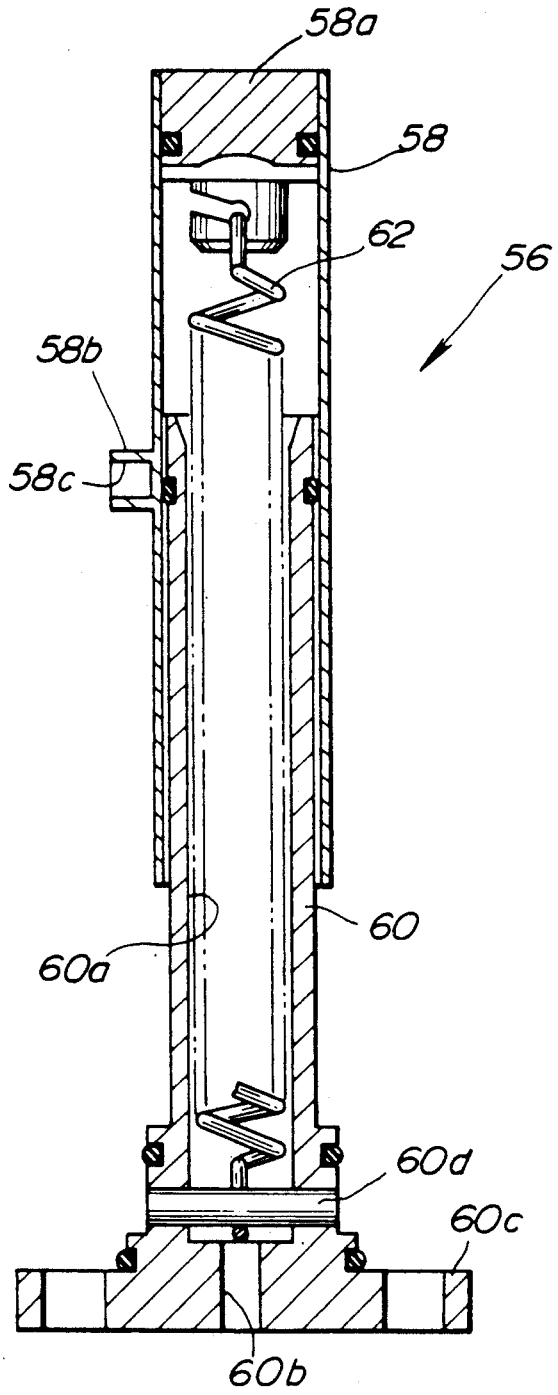
FIG. 4 is a front sectional view of an actuator cylinder used in the compressor in FIG. 1.

In addition, the head cover 24 is provided with an actuator cylinder 56. As shown in FIG. 4, the actuator cylinder 56 comprises a cylinder 58 and a piston 60 slidably inserted into the cylinder 58. A cylindrical pressure chamber 60*a*, which extends in the direction of the axis of the piston 60, is formed in the piston 60. The bottom end of the piston 60 is provided with a supply port 60*b*, which is in communication with the interior of the pressure chamber 60*a*, and a flange 60*c* which is used for mounting the actuator cylinder 56 on the head cover 24. In addition, the bottom end of the piston 60 is provided with a pin 60*d* which extends perpendicular to the axis of the piston 60 and which passes through the bottom end of the piston 60. The top end of the cylinder 58 is covered with cap 58*a*. A coil spring 62 is provided between the inside wall of the cap 58*a* and the bottom end of the piston 60 so as to bias the cylinder in the downward direction in FIG. 4. In addition, an engaging portion 58*b* is formed on the outer periphery of the cylinder 58 at essentially the middle position of the cylinder 58. The engaging portion 58*b* is provided with a long groove 58*c* extending perpendicular to the axis of the cylinder 58. As shown in FIG. 1, the actuating projection 54 engages the groove 58*c*. When the cylinder 58 is moved along the axis thereof, the longitudinal movement of the cylinder 58 is transmitted to the rotatable disc 14 by means of the actuating projection 54 so that the rotatable disc 14 rotates about the axis of the rotor 18. Furthermore, the supply port 60*b* is in communication with the discharge chamber 36 or the aspirator chamber 30 through a directional control valve not shown, so that high-pressure or low-pressure refrigerant gas can be supplied to the interior of the pressure chamber 60*a*.

Referring to FIGS. 1 and 2, operation of the invention is described below.

The revolving shaft of the rotor 18 may be connected to an engine of a vehicle or the like to be actuated. When the rotor 18 is actuated to rotate clockwise in FIG. 2, the vanes 20 project radially due to centrifugal force and back pressure of the vanes 20. As a result, the tips of the vanes 20 remain in contact with the cam surface 10*a* of the cam ring 10 as they rotate. Refrigerant gas is supplied to the interior of the compressor through the inlet 38. The refrigerant gas is compressed to become a high-pressure, high-temperature gas and is supplied to an evaporator not shown through the discharge chamber 36. In this case, when high-pressure refrigerant gas in the discharge chamber 36 is supplied to the pressure chamber 60*a* of the actuator cylinder 56 through the supply port 60*b* of the actuator cylinder 56 by actuating the directional control valve, the cylinder 58 is moved upwardly in FIG. 4 against the biasing force of the coil spring 62. As a result, as shown in FIG. 2, the actuating projection 54 of the ring plate 50, which engages the groove 58*c* of the actuator cylinder 56, is thrusted upwardly, so that the rotatable disc 14 rotates clockwise by means of the ring plate 50 and the actuating pin 21. As a result, the opened position of the by-pass opening 40 relative to the working chamber 26 is shifted to the position expressed by the chain double-dashed line in FIG. 2, so that the amount of the by-passed refrigerant gas is increased, thereby the discharge of the compressor is decreased. Conversely, when low-pressure refrigerant gas in the aspirator chamber 30 is supplied to the pressure chamber 60*a* of the actuator cylinder 56 through the supply port 60*b* by actuating the directional control valve, the cylinder 58 is moved downwardly in FIG. 4 by means of the biasing force of the coil spring 62. As a result, the actuating projection 54 of the ring plate 50 is thrusted downwardly, so that the rotatable disc 14 rotates counterclockwise by means of the ring plate 50 and the actuating pin 52. As a result, the opened position of the by-pass opening 40 relative to the working chamber 26 is shifted to the position expressed by the continuous line in FIG. 2, so that the amount of the by-passed refrigerant gas is decreased, and thereby the discharge of the compressor is increased.

Figure 5:
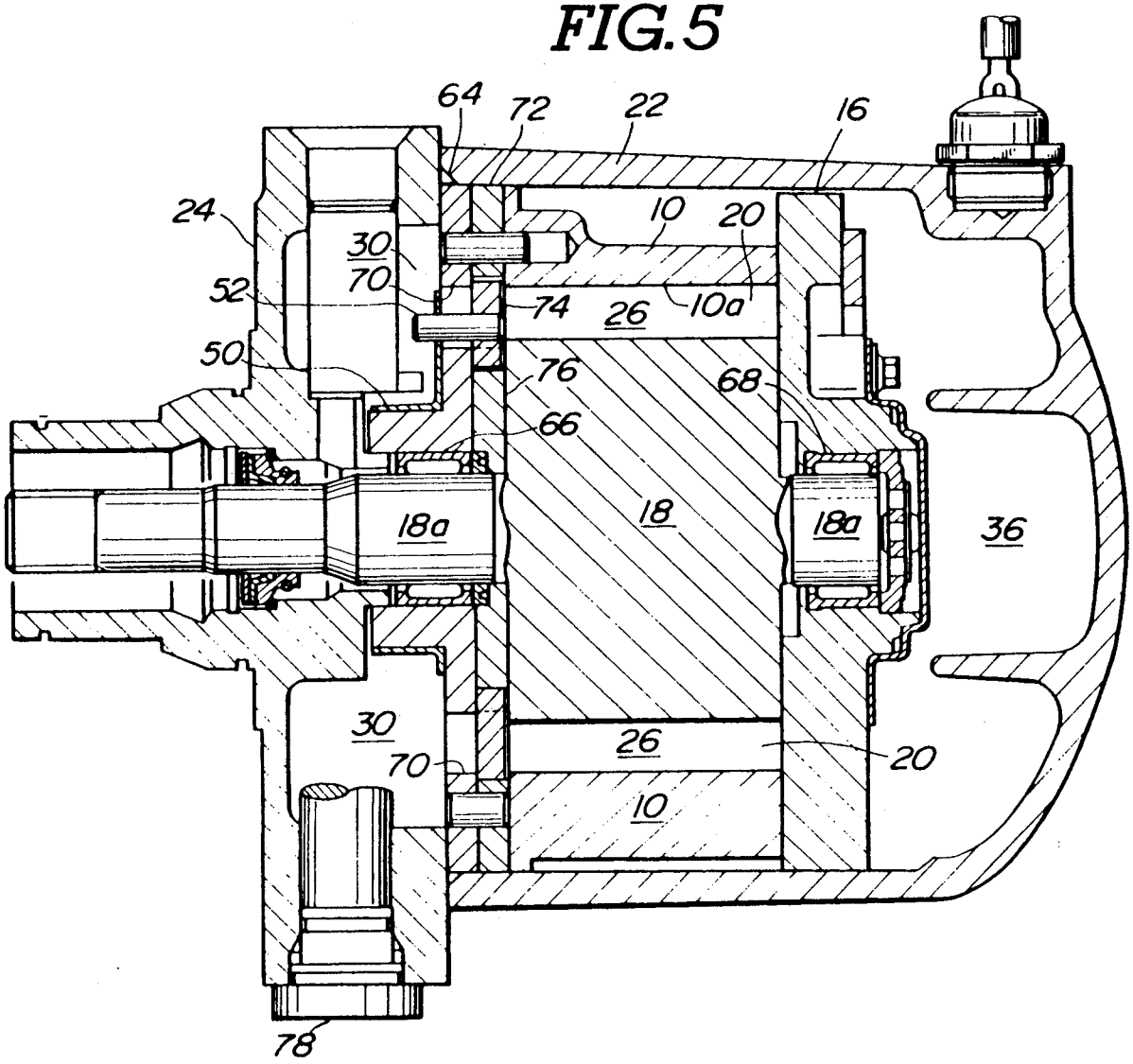
FIG. 5 is a sectional view of the second preferred embodiment of a variable-delivery vane-type rotary compressor according to the invention.
Figure 6:
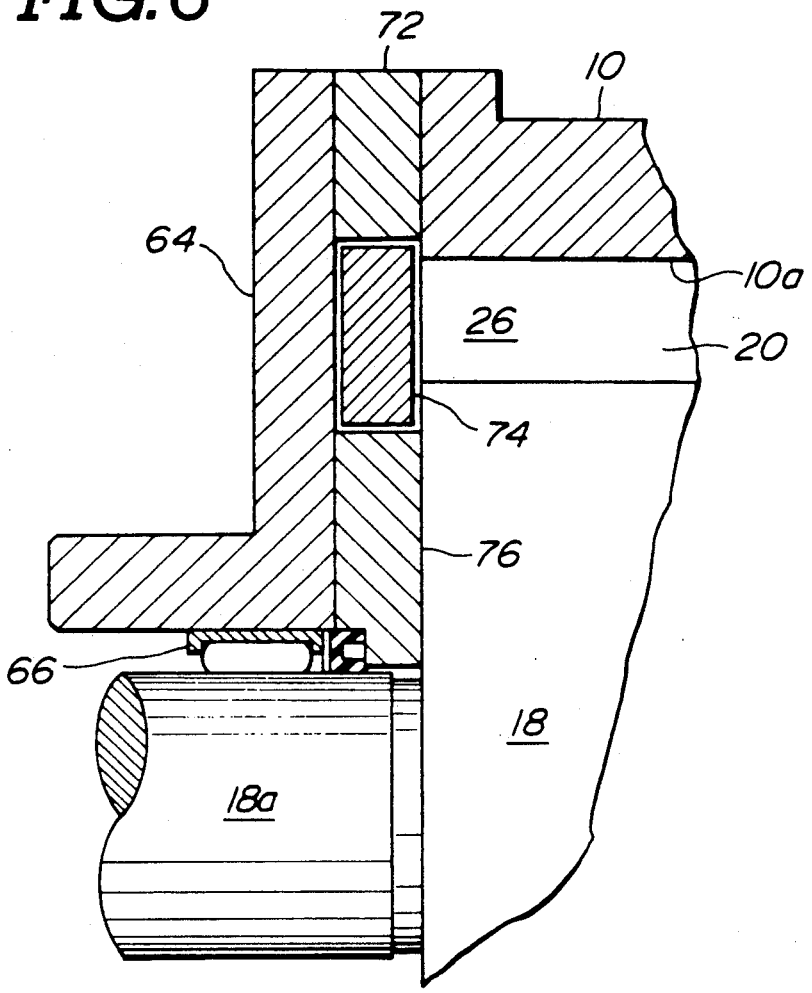
FIG. 6 is a partially expanded sectional view showing the main part of the compressor of FIG. 5.
Figure 7:
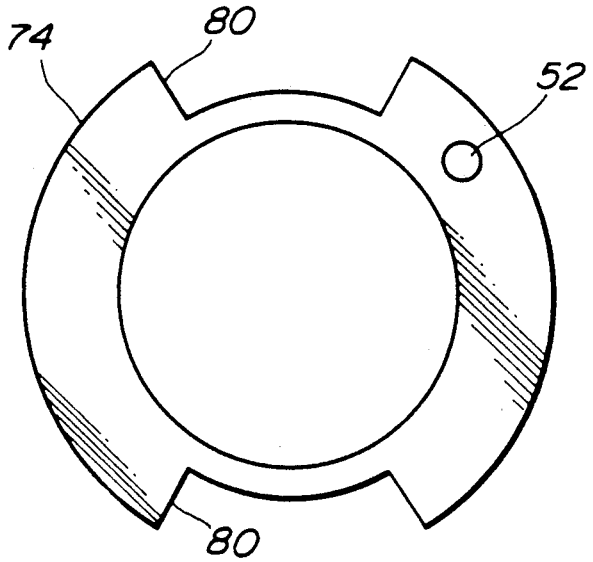
FIG. 7 is a plan view of a rotatable disc used in the compressor in FIG. 5.
Figure 8:
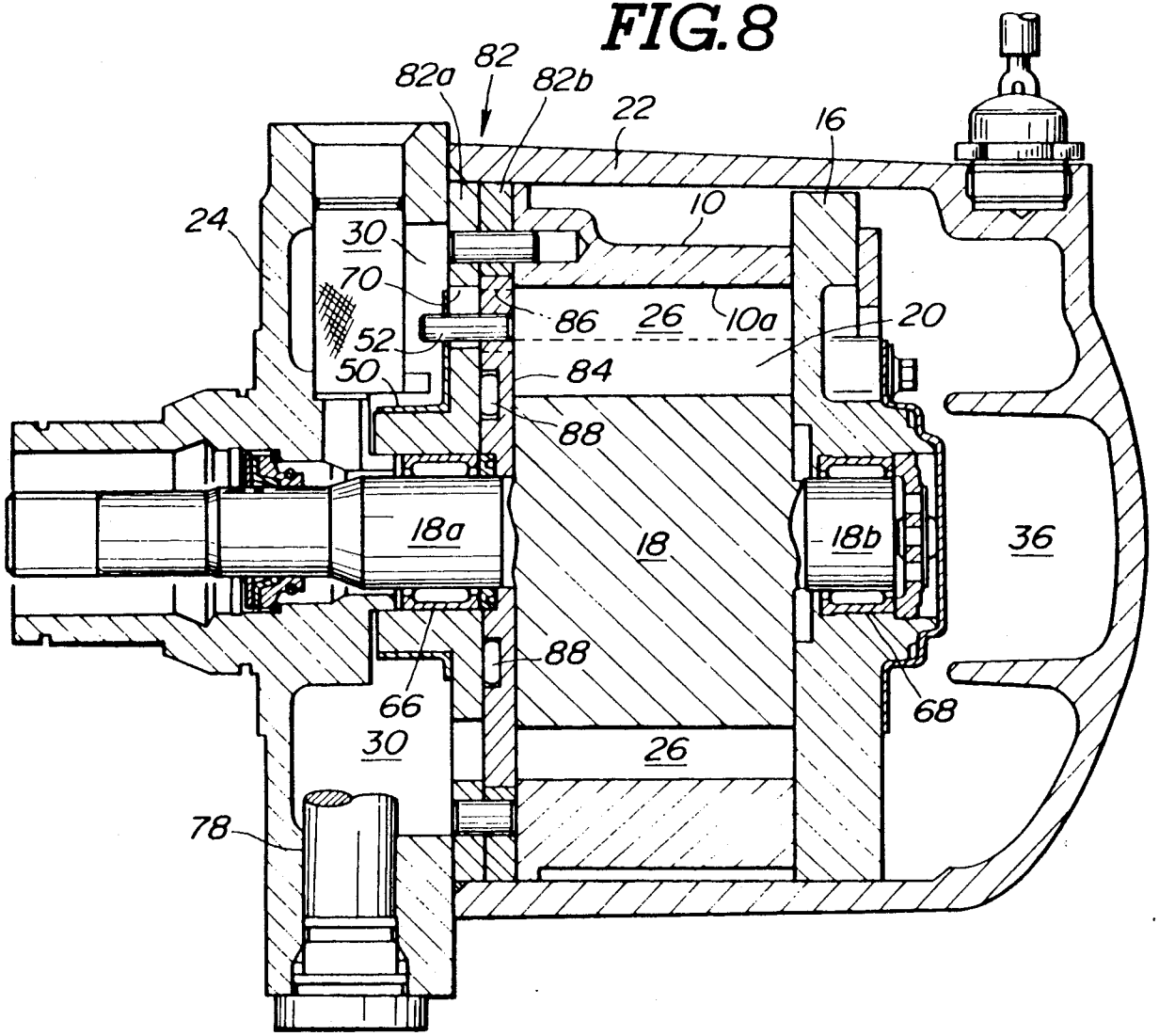
FIGS. 8 to 10 and FIG. 13 are sectional views of third preferred embodiment of a variable-delivery vane-type rotary compressor according to the invention.

FIGS. 5 to 7 show the second embodiment of a variable-delivery vane-type rotary compressor according to the present invention.

Similar to the first preferred embodiment, this embodiment also includes a cylindrical cam ring 10. A cam surface 10*a*, which has an essentially elliptical cross-section, is formed on the inside surface of the cam ring 10. The cam ring 10 is equipped with front and rear plates 64 and 16 at both open ends so as to cover the open ends of the cam ring 10. An essentially cylindrical rotor 18 is rotatably housed in the cam ring 10 between the front plate 64 and the rear plate 16. The shaft 18*a* of the rotor 18 is rotatably supported by bearings 66 and 68 fixed to the front and rear plates 64 and 16. A plurality of vanes 20 are inserted into the rotor 18. The vanes 20 can move inwardly and outwardly so that the tips of the vanes 20 remain in slidable contact with the cam surface 10*a*. The cam ring 10, the front and rear plates 64 and 16 and the rotor 18 are housed in a cylindrical housing 22 having a bottom. The front open end of the housing 22 is covered with a head cover 24 which is fixed to the housing 22 by means of a bolt not shown.

A pair of working chambers 26 are formed between the cam ring 10 and the rotor 18. The working chambers 26 respectively are in communication with an aspirator chamber 30 and a discharge chamber 36 by means of a suction port and a discharge port not shown, the end openings of which are formed on the cam surface 10*a*.

The front plate 64 is provided with a pair of arc-shaped by-pass ports 70 which extend along the working chamber 26 so as to be in communication with the aspirator chamber 30.

According to the second preferred embodiment of the invention, an outer ring 72 having a circular opening is provided between the front plate 64 and the cam ring 10. As shown in FIG. 6, a rotatable ring 74 is disposed in the opening of the outer ring 72. In addition, an inner ring 76 is provided in the inner periphery of the rotatable ring 74 between the front plate 64 and rotor 18, so that the rotatable ring 74 is rotatably supported by the outer and inner rings 72 and 76. The thicknesses of the outer and inner rings 72 and 76 are larger than that of the rotatable ring 74 so that thrust load of the rotor 18 is applied to the inner ring 76, thereby it is not applied to the rotatable ring 74. The rotatable ring 74 is provided with an actuating pin 52 which passes through a ring plate 50 to be connected with an actuator 78. By operating the actuator 78, the rotatable ring 74 can rotate about the axis of the shaft 18*a* of the rotor 18. As shown in FIG. 7, a pair of arc-shaped by-pass openings 80 is formed in the rotatable ring 74, which can control the open area of the by-pass ports 70 of the front plate 64. The by-pass opening 80 establishes the communication between the working chamber 26 and the by-pass port 70 of the front plate 64. When the rotatable ring 74 rotates about the axis of the shaft 18*a*, the open area of the by-pass opening 80 is varied. As a result, the amount of refrigerant gas by-passed from the working chamber 26 to the aspirator chamber 30 through the by-pass port 70 can be controlled, so that the discharge of the compressor can be varied.

When discharge of the compressor is excessive relative to the cooling load of the evaporator, the actuator 78 allow the rotatable ring 74 to rotate by means of the ring plate 50 and the actuating pin 52 so that the open area of the by-pass opening 80 is increased, thereby the discharge is decreased. Conversely, when discharge of the compressor is not enough to satisfy the cooling load of the evaporator, the open area of the by-pass opening 80 is decreased by rotating the rotatable ring 74, so that the discharge is increased.

According to this embodiment of the invention, the inner ring 76 is provided between the front plate 64 and the rotor 18 so that the thickness of the inner ring 76 is larger than that of the rotatable ring 74. Therefore, since thrust load, which is applied to the rotor 18 due to back pressure of the vanes 20, is applied to the inner ring 76, it is not applied to the rotatable ring 74 so that the rotatable ring 74 can rotate smoothly. Consequently, driving force of the actuator 78, which actuates the rotatable ring 74, can be markedly decreased. As a result, parts actuating the rotatable ring 74, such as the actuator 78 and the ring plate 50, can be compact so that the compressor can be compact and its weight as a whole can be light.

Although the front plate 64, the outer ring 72 and the inner ring 76 are separately provided in the compressor according to the aforementioned embodiment, the front plate 64 can also be integrally formed with the outer ring 72 or the inner ring 76, or the outer ring 72 and the inner ring 76.

FIGS. 8 to 14 show the third preferred embodiment of a variable-delivery vane-type rotary compressor according to the present invention.

Similar to the aforementioned embodiments, this embodiment also includes a cylindrical cam ring 10. A cam surface 10*a*, which has an essentially elliptical cross-section, is formed on the inside surface to the cam ring 10. The cam ring 10 is equipped with a front plate 82, which comprises a circular plate portion 82*a* and a ring portion 82*b*, at the front open end so as to cover the front open end of the cam ring 10. The cam ring 10 is also equipped with an essentially disc-shaped rear plate 16 at the rear end so as to cover the rear open end of the cam ring 10. An essentially cylindrical rotor 18, which is integrally formed with front and rear shafts 18*a* and 18*b*, is housed in the cam ring 10 between the front plate 82 and the rear plate 16. The shafts 18*a* and 18*b* of the rotor 18 is rotatably supported by the front and rear plates 82 and 16 by means of bearings 66 and 68. A plurality of vanes 20 are inserted into the rotor 18. The vanes 20 can move inwardly and outwardly so that the tips of the vanes 20 are in slidable contact with the cam surface 10*a*. The cam ring 10, the front and rear plates 82 and 16 and the rotor 18 are housed in a cylindrical housing 22 having a bottom. The front open end of the housing 22 is covered with a head cover 24 which is fixed to the housing 22 by means of a bolt not shown.

A pair of working chambers 26 are formed between the cam ring 10 and the rotor 26. The working chambers 26 respectively are in communication with an aspirator chamber 30 and a discharge chamber 36 by means of a suction port and a discharge port not shown, the end openings of which are formed on the cam surface 10*a*.

The front plate 64 is provided with a pair of arc-shaped by-pass ports 70 which extend along the working chamber 26 so as to be in communication with the aspirator chamber 30.

Figure 11:
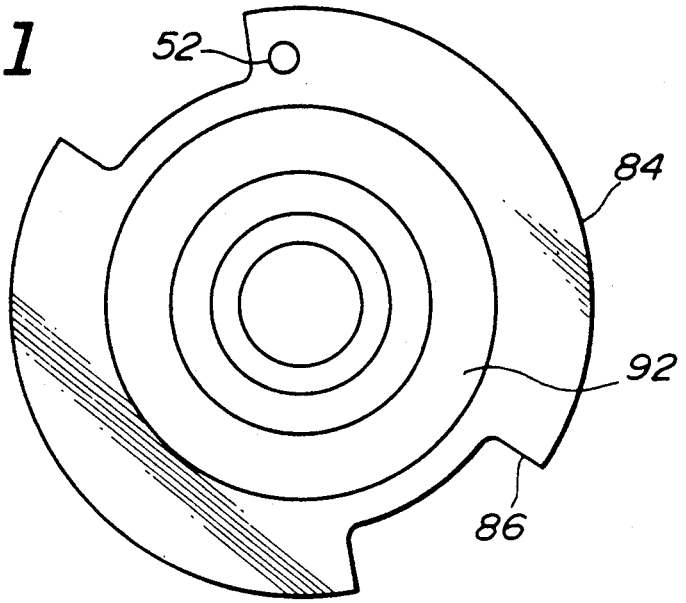
FIGS. 11 and 12 are plan views showing a pad or pads fixed to a rotatable disc used in the compressor in FIG. 10.
Figure 12:
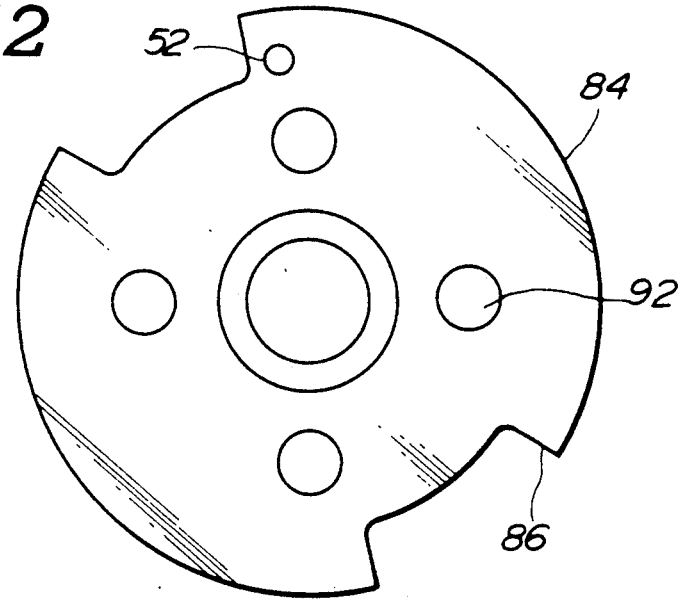

A rotatable disc 84, which can rotate above the axes of the front and rear shafts 18*a* and 18*b*, is provided between the front plate 82 and the rotor 18. As shown in FIGS. 11 and 12, a pair of arc-shaped by-pass opening 86 is formed in the rotatable disc 84, which can control the open area of by-pass ports 70 formed in the front plate 82. The rotatable disc 84 is provided with an actuating pin 52 which is connected with an actuator 78 by means of a ring plate 50. By driving the actuator 78, the rotatable disc 84 can rotate about the axis of the shaft 18*a*. When the rotatable disc 84 rotates, the open area of the by-pass opening 86 is varied. As a result, the amount of refrigerant gas by-passed from the working chamber 26 to the aspirator chamber 30 through the by-pass port 70 can be controlled, so that the discharge of the compressor can be varied.

In addition, a ring-shaped thrust bearing 88 comprising a low-friction member is provided between the front plate 82 and the rotatable disc 84. The thrust bearing 88 is fixed to the surface of the rotatable disc 84. The thrust bearing 88 may be fixed to the surface of the front plate 82. Thrust load of the rotor 18 on the rotatable disc 84 in the direction of the front plate 82 is applied to the thrust bearing 88, so that the rotatable disc 84 can rotate smoothly.

According to this embodiment of the invention, friction between the front plate 82 and the rotatable disc 84 can be decreased by means of the thrust bearing 88 so that the rotatable disc 84 can rotate smoothly. Therefore, driving force required by the actuator 78, to actuate the rotatable disc 84, can be decreased. As a result, the parts for actuating the rotatable disc 84, such as the actuating pin 52, the actuator 78 and ring plate 50, can be compact so that the compressor can be compact and its weight can be light as a whole.

Figure 9:
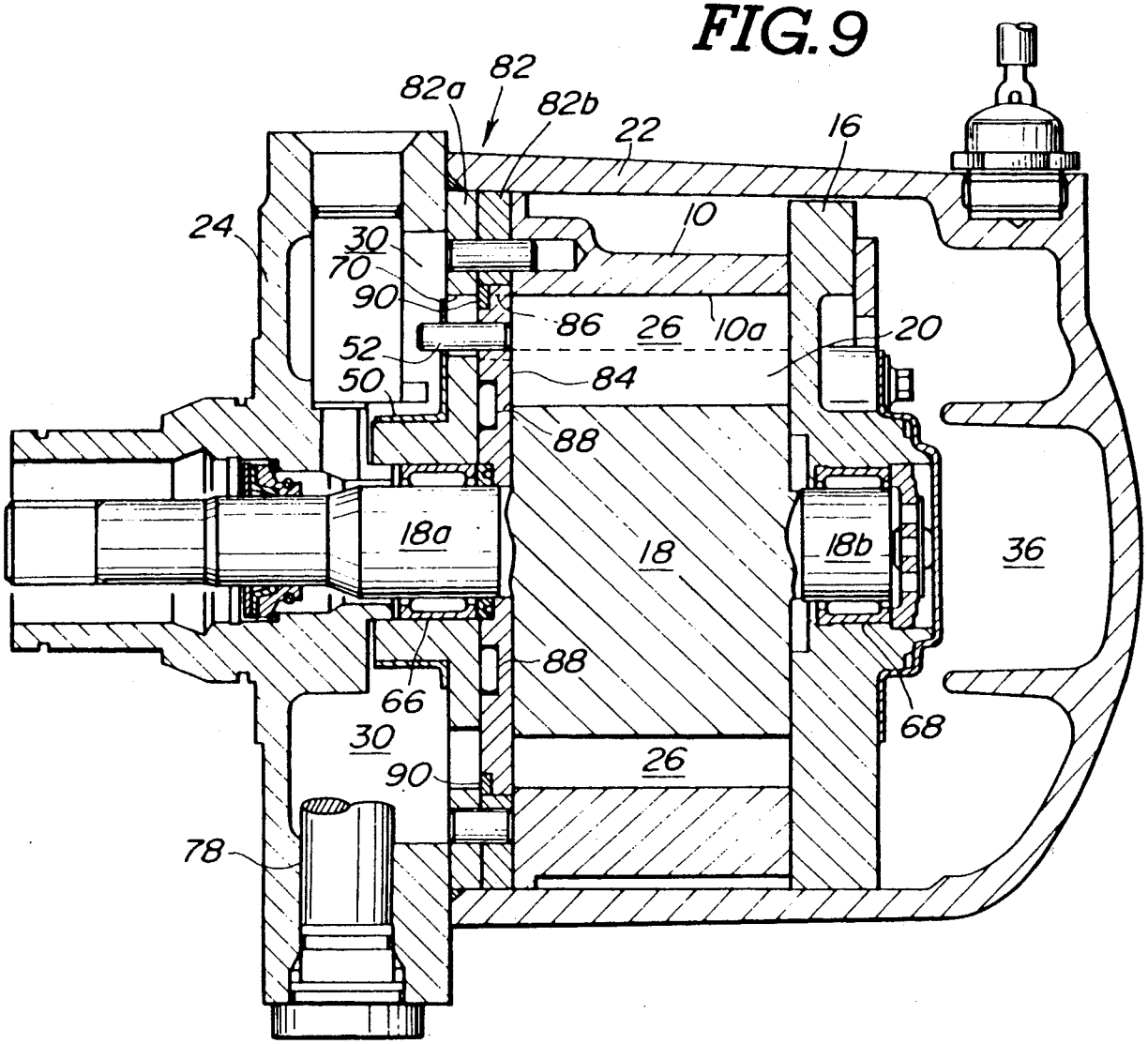

As shown in FIG. 9, according to the third embodiment of the invention, a ring-shaped pad 90 comprising a low-friction member may also be provided between the front plate 82 and the rotatable disc 84 around the thrust bearing 88. The pad 90 is fixed to the surface of the rotatable disc 84. There is a minute clearance between the pad 90 and the front plate 82. Since the coefficient of friction of the pad 90 is low, the pad can cause the rotatable disc 84 to rotate smoothly with the trust bearing 88.

Figure 10:
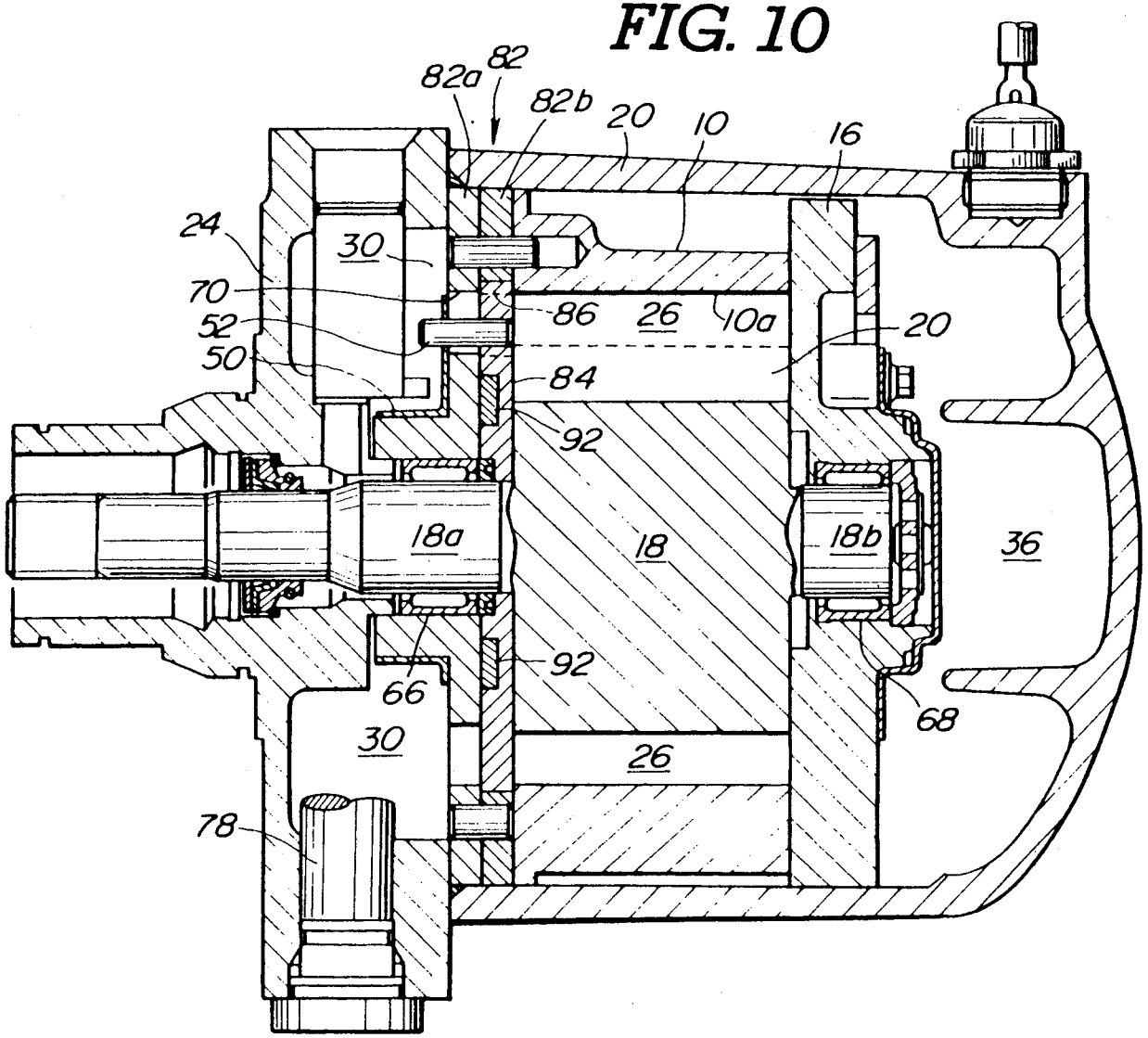

As shown in FIGS. 10 to 12, according to the third embodiment of the invention, a pad or pads comprising a low-friction member may also be provided between the front plate 82 and the rotatable disc 84 around the shaft 18*a* of the rotor 18 in lieu of the thrust bearing 88. The pad is inserted into a groove or grooves formed on the surface of the rotatable disc 84. As shown in FIGS. 4 and 5, the pad may comprise a single ring-shaped member or a plurality of members.

Figure 14:
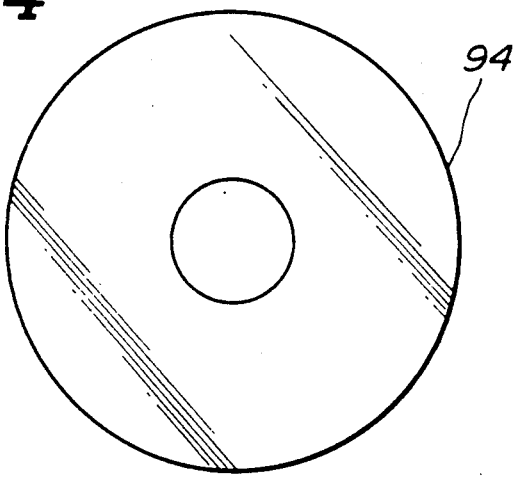
FIG. 14 is a plan view of a pad used in the compressor in FIG. 13.
Figure 13:
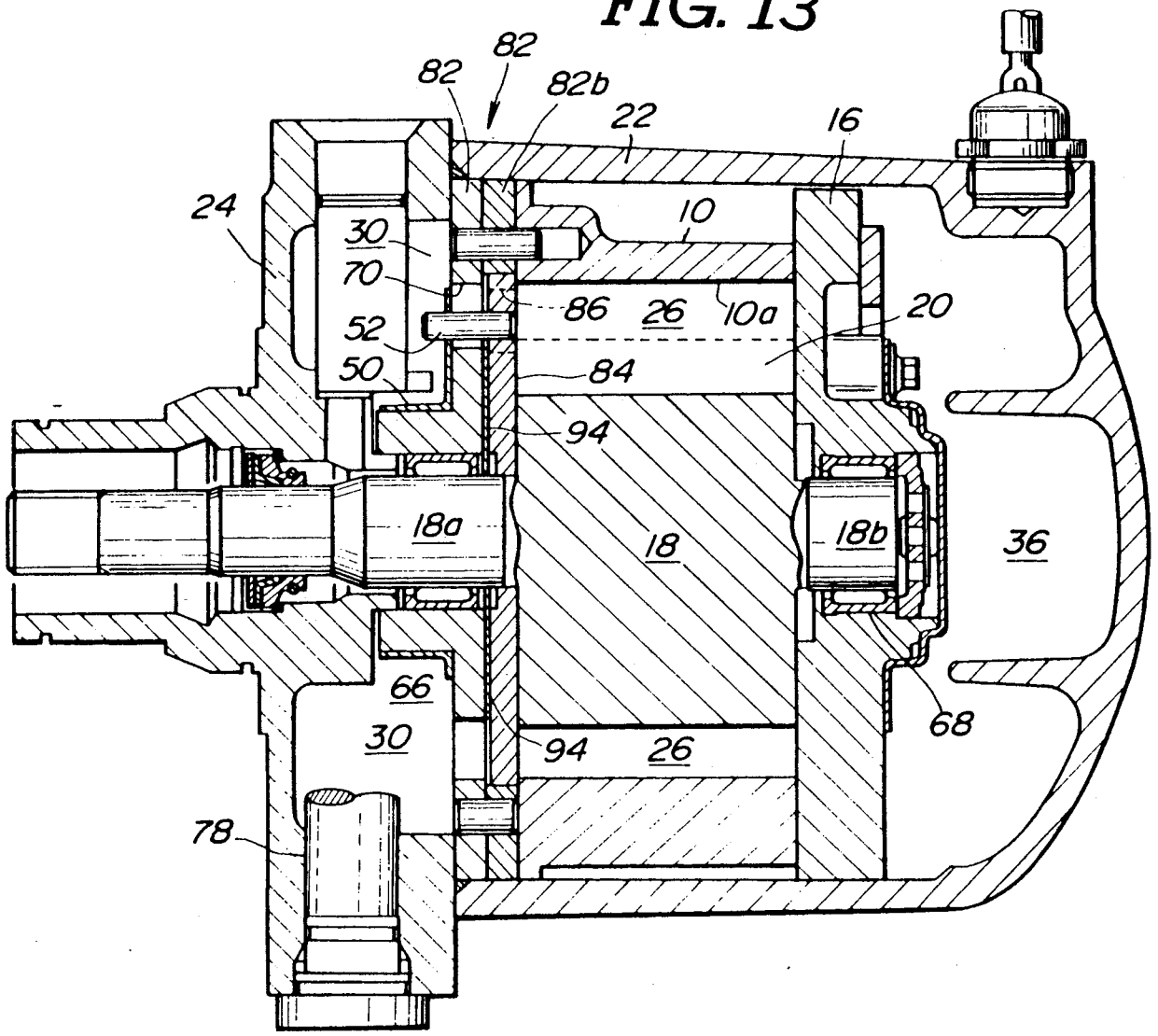

As shown in FIGS. 13 and 14, according to the third embodiment of the invention, a thin ring-shaped pad 94 comprising a low-friction member may also be provided between the front plate 82 and the rotatable disc 84. In this case, the pad 94 can be produced from a thin sheet material by press working and it is not necessary for the front plate 82 and the rotatable disc 84 to be specially processed. Therefore, cost of material and processing can be decreased. Furthermore, a low-friction member may also take the form of a film formed on the front plate 82 or the rotatable disc 84. The front plate 82 or the rotatable disc 84 may also comprise a low-friction material.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A rotary compressor comprising:

a compressor housing defining therein an internal space which includes a low-pressure chamber connected to a low-pressure fluid source and a high-pressure chamber connected to a load;

introducing means for introducing a low-pressure fluid into said low-pressure chamber;

compression means for compressing said low-pressure fluid to a predetermined higher pressure, said compression means including a compression chamber into which said low-pressure fluid is introduced for compression;

passage means for defining a by-pass passage establishing communication between said low-pressure chamber and said compression chamber, said by-pass passage establishing communication between said low-pressure chamber and said compression chamber, said by-pass passage being arranged to be exposable to essentially the entire cross-sectional area of said compression chamber so as to establish communication between said low-pressure chamber and said compression chamber;

rotary closure member associated with said by-pass passage for varying the open area and position at which said by-pass passage is exposed to said compression chamber so as to control the amount of said low-pressure fluid by-passed from said compression chamber to said low-pressure chamber through said by-pass passage, said rotary closure member being a disk-shaped member; and receiving means for defining a circular through opening for receiving therein said rotary closure member, said receiving means allowing said rotary closure member to rotate while the inner surface of said circular through opening being in contact with the outer periphery of said rotary closure member.

2. A rotary compressor comprising:

a compressor housing defining therein an internal space which includes a low-pressure chamber connected to a low-pressure fluid source and a high-pressure chamber connected to a load;

introducing means for introducing a low-pressure fluid into said low-pressure chamber;

compression means for compressing said low-pressure fluid to a predetermined higher pressure, said compression means including a compression chamber into which said low-pressure fluid is introduced for compression;

passage means for defining a by-pass passage establishing communication between said low-pressure chamber and said compression chamber, said by-pass passage establishing communication between said low-pressure chamber and said compression chamber, said by-pass passage being arranged to be exposable to essentially the entire cross-sectional area of said compression chamber so as to establish communication between said low-pressure chamber and said compression chamber;

rotary closure member associated with said by-pass passage for varying the open area and position at which said by-pass passage is exposed to said compression chamber so as to control the amount of said low-pressure fluid by-passed from said compression chamber to said low-pressure chamber through said by-pass passage, said rotary closure member being a disk-shaped member which is actuated by actuating means which comprises a cylinder and a piston slidably inserted into said cylinder and wherein the longitudinal displacement of said cylinder is transmitted to said disk-shaped member by means of an actuating pin provided on said disk-shaped member so as to allow said disk-shaped member to rotate; and receiving means for defining a circular through opening for receiving therein said rotary closure member so as to allow said rotary closure member to rotate while the inner surface of said circular through opening is in contact with the outer periphery of said rotary closure member.

3. A rotary compressor as set forth in claim 2, wherein said compression means comprises a cam ring, the interior of which is provided with a cam surface, a rotor rotatably housed in said cam ring, at least one working chamber formed by said compressor housing, said cam ring and said rotor, and a plurality of vanes inserted into said rotor, said vanes being movable inwardly and outwardly, and the tips of which slide in contact with said cam surface.

4. A rotary compressor as set forth in claim 2, wherein said fluid is a refrigerant gas.

5. A rotary compressor as set forth in claim 4, wherein said low-pressure chamber is connected to an evaporator and wherein said high-pressure chamber is connected to a condenser.

6. A rotary compressor as set forth in claim 2, wherein said rotary closure member is a disc-shaped member which is provided with at least one by-pass opening at the circumference thereof, through which a part of said low-pressure fluid is by-passed from said compression chamber to said low-pressure chamber.

7. A rotary compressor as set forth in claim 6, wherein said space for rotatably receiving said rotary closure member is a circular opening provided in said compression chamber and wherein said disc-shaped member is rotatably supported by said circular opening.

8. A rotary compressor as set forth in claim 7, wherein said by-pass opening is an arc-shaped opening.

9. A rotary compressor as set forth in claim 8, which further comprises actuating means for actuating said disc-shaped member and for controlling the amount of said low-pressure fluid by-passed from said compression chamber to said low-pressure chamber through said passage means.

10. A rotary compressor as set forth in claim 2, wherein said compression means comprises a cam ring, the interior of which is provided with a cam surface, a rotor rotatably housed in said cam ring, at least one working chamber formed by said compressor housing, said cam ring and said rotor, and a plurality of vanes inserted into said rotor, said vanes being movable inwardly and outwardly, and the tips of which slide in contact with said cam surface.

11. A rotary compressor as set forth in claim 10, wherein said rotary closure member is a ring-shaped member which is provided with at least one by-pass opening at the circumference thereof, through which a part of said low-pressure fluid is by-passed from said compression chamber to said low-pressure chamber.

12. A rotary compressor as set forth in claim 11, wherein said receiving means comprises outer and inner rings and wherein said ring-shaped member is rotatably supported between said outer and inner rings.

13. A rotary compressor as set forth in claim 12, wherein the thickness of said ring-shaped member is less than that of outer and inner rings.

14. A rotary compressor as set forth in claim 13, wherein said by-pass opening is an arc-shaped opening.

* * * * *